US006441791B1

(12) United States Patent
Oka

(10) Patent No.: US 6,441,791 B1
(45) Date of Patent: Aug. 27, 2002

(54) GLASS ANTENNA SYSTEM FOR MOBILE COMMUNICATION

(75) Inventor: Hidetoshi Oka, Osaka (JP)

(73) Assignee: Nippon Sheet Glass Co., Ltd., Osaka (JP)

( * ) Notice: Subject to any disclaimer, the term of this patent is extended or adjusted under 35 U.S.C. 154(b) by 0 days.

(21) Appl. No.: 09/664,804

(22) Filed: Sep. 19, 2000

(30) Foreign Application Priority Data

Aug. 21, 2000 (JP) ..... 2000-250103

(51) Int. Cl.[7] ..... H01Q 1/32
(52) U.S. Cl. ..... 343/713; 343/825; 343/846
(58) Field of Search ..... 343/704, 711, 343/712, 713, 829, 846, 847, 848, 825

(56) References Cited

U.S. PATENT DOCUMENTS

| | | | | |
|---|---|---|---|---|
| 5,406,295 A | | 4/1995 | Baranski et al. | 343/713 |
| 5,521,606 A | * | 5/1996 | Ijiima et al. | 343/713 |
| 5,738,529 A | * | 4/1998 | Wedell et al. | 439/63 |
| 6,028,557 A | * | 2/2000 | Oka | 343/713 |

FOREIGN PATENT DOCUMENTS

| | | |
|---|---|---|
| JP | 6-276009 | 9/1994 |
| JP | 6-291530 | 10/1994 |
| JP | 6-291531 | 10/1994 |
| JP | 6-303025 | 10/1994 |
| JP | 7-297615 | 11/1995 |
| JP | 8-139513 | 5/1996 |
| JP | 8-162827 | 6/1996 |
| JP | 8-213820 | 8/1996 |
| JP | 993256 | 10/1997 |
| JP | 9-321518 | 12/1997 |
| JP | 1001327 | 1/1998 |
| JP | 10-93332 | 4/1998 |
| JP | 11-251825 | 9/1999 |

OTHER PUBLICATIONS

International Search Report

* cited by examiner

*Primary Examiner*—Don Wong
*Assistant Examiner*—Shih-Chao Chen
(74) *Attorney, Agent, or Firm*—Merchant & Gould PC

(57) ABSTRACT

The present invention provides a glass antenna device for mobile communication with suitable impedance matching for two different frequency bands. In this antenna device, the ends of a substantially straight first radiation antenna pattern and a second radiation antenna pattern are coupled by a coupling pattern that is substantially perpendicular to the first and second radiation antenna patterns. The longitudinal direction of the coupling pattern is arranged substantially in parallel to the ground. The length of the first radiation antenna pattern is different from the length of the second radiation antenna pattern. A rectangular grounding pattern is arranged below this U-shaped antenna pattern. A core conductor of a coaxial cable is connected to the U-shaped antenna pattern, and a braided conductor of the coaxial cable is connected to the grounding pattern. An impedance-adjusting pattern is provided on a lateral portion of the grounding pattern.

12 Claims, 13 Drawing Sheets

GLASS ANTENNA SYSTEM FOR MOBILE COMMUNICATION

BACKGROUND OF THE INVENTION

1. Field of the Invention

The present invention relates to a glass antenna device for mobile communication, and more particularly to a glass antenna device for mobile communication that can be installed on the window glass of a vehicle and can carry two different frequency bands.

2. Description of the Related Art

As an example of such an antenna, the assignee of the present invention has proposed a frequency switch type glass antenna in JP H6-291530A. This glass antenna includes a V-shaped radiation antenna pattern of differing length, and a grounding pattern arranged below that. A glass antenna in which the V-shaped radiation antenna pattern is made into a U-shape is disclosed as well. This glass antenna is specifically for car telephone transmission and reception in the 800 MHz band and the 1.5 GHz band. In this glass antenna, the core conductor of the coaxial cable that is arranged traversing the center of the grounding pattern is connected with the lower end of the V-shaped (or U-shaped) radiation antenna pattern.

In JP H8-162827A, the assignee of this invention has disclosed a glass antenna device for a car telephone. One feature of this glass antenna device for a car telephone is that it is provided with parallel impedance-adjusting portions running along the defogging heater conductors. The grounding pattern has a complicated shape.

In JP H7-297615A, the assignee of this invention has disclosed a window glass antenna device for a car. FIGS. 15 and 20 of that publication disclose a glass antenna that can carry two frequency bands.

In JP H6-276009A, JP H6-291531A, JP H6-303025A, JP H7-297615A, JP H8-139513A, JP H8-213820A and JP H9-321518A, the assignee of this invention has disclosed a glass antenna that can switch between the 800 MHz band and the 1.5 GHz band.

For suitable transmission and reception in different frequency bands with the glass antenna disclosed in JP H6-291530A, further improvements were necessary. That is to say, it was necessary to match the impedances adequately for the different frequency bands. In the glass antenna device disclosed in JP H8-162827A, on the other hand, a complicated conductive pattern was necessary, and parallel impedance adjusting portions were provided along the defogging heater conductors, so that there were problems with regard to the outward appearance. The glass antenna for car windows disclosed in JP H7-297615A can carry two frequency bands, but it needs two coaxial cables for that case.

SUMMARY OF THE INVENTION

It is thus an object of the present invention to provide a glass antenna device for mobile communication, in which impedance matching can be achieved for two frequency bands while preserving the features of the glass antenna disclosed in JP H6-291530A.

To attain these objects, a glass antenna device for mobile communication in accordance with the present invention includes an overall U-shaped antenna pattern, in which one end of a substantially straight first radiation antenna pattern and one end of a substantially straight second radiation antenna pattern are coupled by a coupling pattern that is substantially perpendicular to the first and second radiation antenna patterns. In this glass antenna device, the longitudinal direction of the coupling pattern is arranged substantially in parallel to the ground, and the length of the first radiation antenna pattern is different from the length of the second radiation antenna pattern.

Furthermore, a rectangular grounding pattern is arranged below the U-shaped antenna pattern. A core conductor of a coaxial cable is connected to the U-shaped antenna pattern, and a braided conductor of the coaxial cable is connected to the grounding pattern. An impedance-adjusting pattern is provided on a lateral portion of the grounding pattern.

The glass antenna device for mobile communication of the present invention uses a U-shaped antenna pattern, in which the ends of two radiation antenna patterns of different length are coupled, so that two different frequencies can be resonated. Therefore, it is not necessary to provide a shorting member or a switch or the like for switching frequencies. Furthermore, an impedance-adjusting pattern is provided at the grounding pattern, so that the glass antenna device of the present invention displays excellent transmission and reception characteristics in two different frequency bands.

DESCRIPTION OF THE PREFERRED EMBODIMENTS

Figure 1:
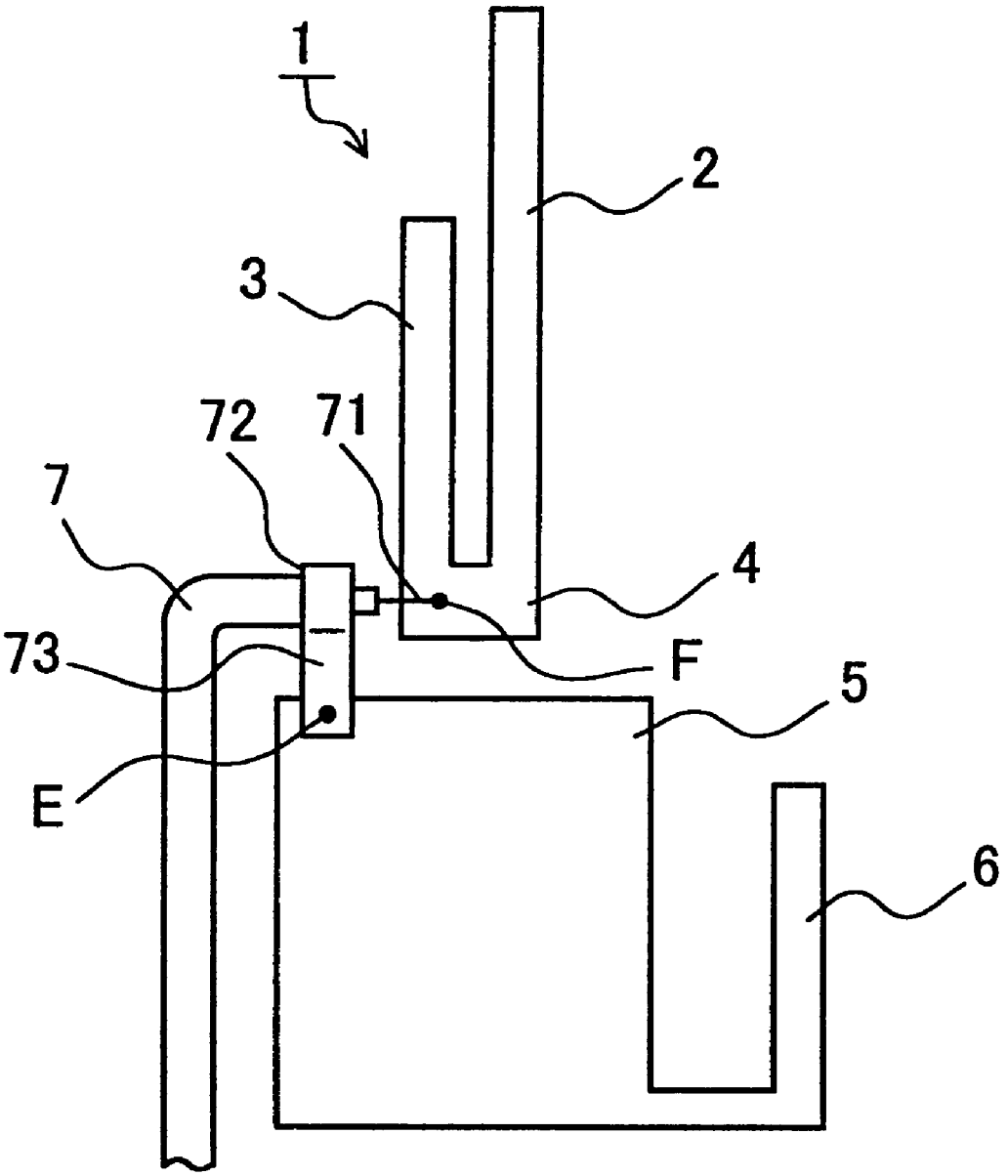
FIG. 1 is a plan view of an embodiment (Example 1) of a glass antenna device for mobile communication in accordance with the present invention.

In the glass antenna device for mobile communication of the present invention, it is preferable that the impedance-adjusting pattern is substantially L-shaped. When the impedance-adjusting pattern is L-shaped, a configuration is attained in which the glass antenna device for mobile communication can carry two frequencies on a relatively small area.

In the glass antenna device for mobile communication of the present invention, it is preferable that the length of the first radiation antenna pattern is approximately $\lambda_1/4$–$\lambda_1/6$ with $\lambda_1$ being a first wavelength, and wherein the length of the second radiation antenna pattern is approximately $\lambda_2/4$–$\lambda_2/6$ with $\lambda_2$ being a second wavelength, It is also preferable that the horizontal length and the vertical length of the grounding pattern are both approximately $\lambda_2/4$–$\lambda_2/6$. It is also preferable that a length of the impedance-adjusting pattern is approximately $\lambda_1/4$–$\lambda_1/6$. It is preferable that the impedance-adjusting pattern is provided at a lower portion of the lateral portion of the grounding pattern.

In the glass antenna device for mobile communication of the present invention, it is preferable that electricity is supplied to the U-shaped antenna pattern by connecting the core conductor of the coaxial cable, which is arranged along an outer peripheral portion of the grounding pattern, to the coupling pattern.

In the glass antenna device for mobile communication of the present invention, it is preferable that the coaxial cable does not overlap with the grounding pattern. Arranging the coaxial cable in this manner, it is possible to adjust the impedances even more suitably.

In the glass antenna device for mobile communication of the present invention, it is preferable that a width of the radiation antenna pattern is approximately 1–5 mm. It is also preferable that a spacing between the first radiation antenna pattern and the second radiation antenna pattern is approximately 2–10 mm.

Setting the size of the radiation antenna patterns and the grounding pattern according to certain conditions as described above, frequency characteristics that are close to those of a monopole antenna can be attained.

In the glass antenna device for mobile communication of the present invention, it is preferable that the U-shaped antenna pattern and the grounding pattern are provided on one glass epoxy substrate. Such a glass antenna device can be attached easily to a window glass or the like, for example with double-sided adhesive tape. In this case, it is preferable that the glass antenna device further includes a cladding case having a guide groove portion for covering the grounding pattern, accommodating one end of the coaxial cable and holding the cable. Using such a cladding case, the coaxial cable can be installed easily and reliably.

The following is a description of examples of the present invention, with reference to the accompanying drawings. The following description relates to antennas for the 800 MHz band and the 1.8 GHz band, but the resent invention is not limited to a combination of these two frequency bands.

It should be noted that the 1.8 GHz band is currently used for mobile communication in Europe and North America.

EXAMPLE 1

FIG. 1 shows an example of an antenna pattern of a glass antenna device for mobile communication in accordance with the present invention. This antenna pattern can be formed directly on the window glass of a vehicle, or formed on a glass epoxy substrate and then attached to the window glass.

A U-shaped antenna pattern 1 includes a first radiation antenna pattern 2 and a second antenna pattern 3 of different length that are substantially straight, and a coupling pattern 4. The longitudinal direction of the coupling pattern 4 is arranged parallel to the ground. With this configuration, the first and the second radiation antenna patterns 2 and 3 are arranged in a perpendicular direction with respect to the ground at least when seen from a certain direction, although this depends also on the angle with which the main glass antenna device is attached.

A rectangular grounding pattern 5 is arranged below the U-shaped antenna pattern 1. An L-shaped impedance-adjusting pattern 6 extends from the bottom of one of the sides of the grounding pattern 5.

The core conductor 71 of a coaxial cable 7 is connected with a feeding point F of the coupling pattern 4, and the braided conductor 72 of the coaxial cable 7 is connected via a fitting 73 to a connection point E of the grounding pattern. The other end of the cable 7 is connected with an antenna terminal, for example of a car telephone (not shown in the drawings).

Thus, since the coupling pattern 4 of the two radiation antenna patterns 2 and 3 of different length is provided with a feeding point F, the resonance of two different frequencies is possible. Therefore, it is not necessary to provide a shorting member or a switch or the like for switching frequencies. Consequently, a glass antenna device that can handle two frequency bands can be realized with a simple configuration.

On the other hand, the grounding pattern 5 is shared for basically two frequency bands. Furthermore, the newly provided impedance-adjusting pattern 6 is L-shaped. Consequently, the glass antenna device of this Example 1 is not as wide as a monopole antenna.

The following is an explanation of the design of the various patterns. First of all, the radiation antenna patterns are determined by the relation $$\lambda_n=(c/f_n)\times k \qquad \text{(Eq. 1)}$$

wherein $\lambda_n$ (m) is the wavelength for the resonance frequency $f_n$ (Hz), and c is the speed of light ($3\cdot10^8$m/s). k is a shortening factor if the antenna element is provided on a dielectric, and is about 0.7 in the present embodiment.

According to Eq. 1, the wavelength $\lambda_1$ for frequencies in the 800–1000 MHz band is about 200 mm. It is suitable to make the length of the first radiation antenna 2, for example, approximately $\lambda_1/4$ Consequently, the length of the first radiation antenna pattern 2 is about 45 mm in this case.

Similarly, according to Eq. 1, the wavelength $\lambda_2$ for frequencies in the 1.8–2 GHz band is about 100 mm. Thus, the length of the second radiation antenna 3 can be set to approximately $\lambda_2/4$. Consequently, the length of the second radiation antenna pattern 3 is about 28 mm in this case.

The width of the first radiation antenna pattern 2 and the second radiation antenna pattern 3 was set to 4 mm. It is suitable to set the width of the radiation antenna patterns to approximately 1–5 mm. The width of the coupling pattern 4 was set to 6 mm.

The distance between the first radiation antenna pattern 2 and the second radiation antenna pattern 3 was set to 3 mm. It is suitable to set the width of the radiation antenna patterns to approximately 2–10 mm, more preferably to 3–7 mm.

On the other hand, it is suitable to set the vertical length and the horizontal length of the rectangular grounding pattern 5 to approximately $\lambda_2/4$–$\lambda_2/6$. That is to say, it is suitable to set the vertical length and the horizontal length to about 25–50 mm. In this Example 1, the vertical length was set to 35 mm and the horizontal length was set to 30 mm.

It is suitable to set the total length of the L-shaped impedance-adjusting pattern 6 to approximately $\lambda_1/4$–$\lambda_1/6$. In this Example 1, it was set to 40 mm.

The grounding pattern 5 is shared for basically two frequency bands, but the size of the rectangle is based the wavelength $\lambda_2$. The length of the adjusting pattern 6 is based on the wavelength $\lambda_1$. Thus, the impedances of both the first radiation antenna pattern 2 and the second radiation antenna pattern 3 are adjusted.

It is suitable to provide the impedance-adjusting pattern on the left or the right side of the grounding pattern.

EXAMPLE 2

Figure 2:
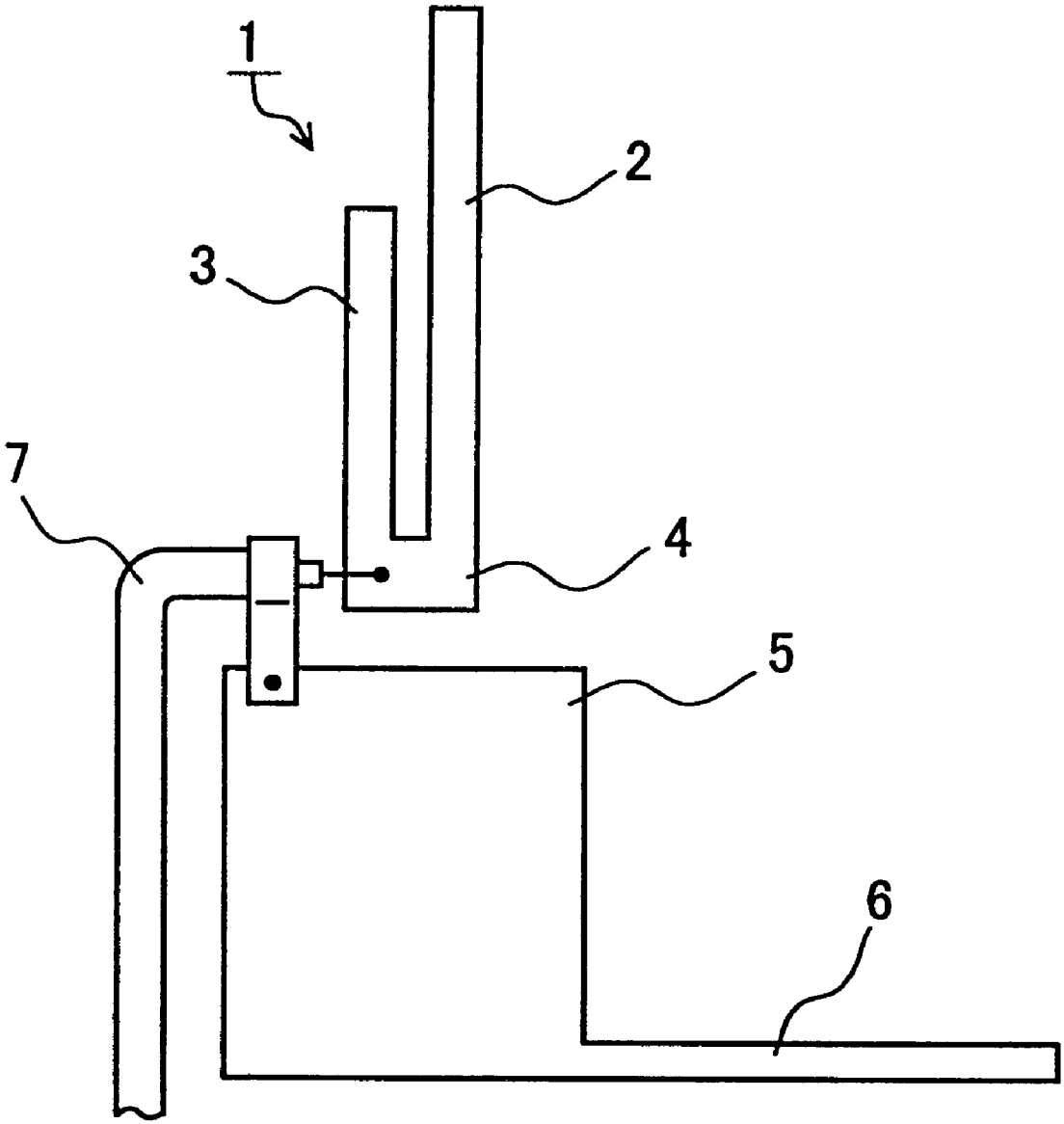
FIG. 2 is a plan view of another embodiment (Example 2) of a glass antenna device in accordance with the present invention.

Example 2 is an example of a configuration in which the impedance-adjusting pattern 6 in Example 1 is straight (see FIG. 2). Other aspects are the same as in Example 1.

EXAMPLE 3

Figure 3:
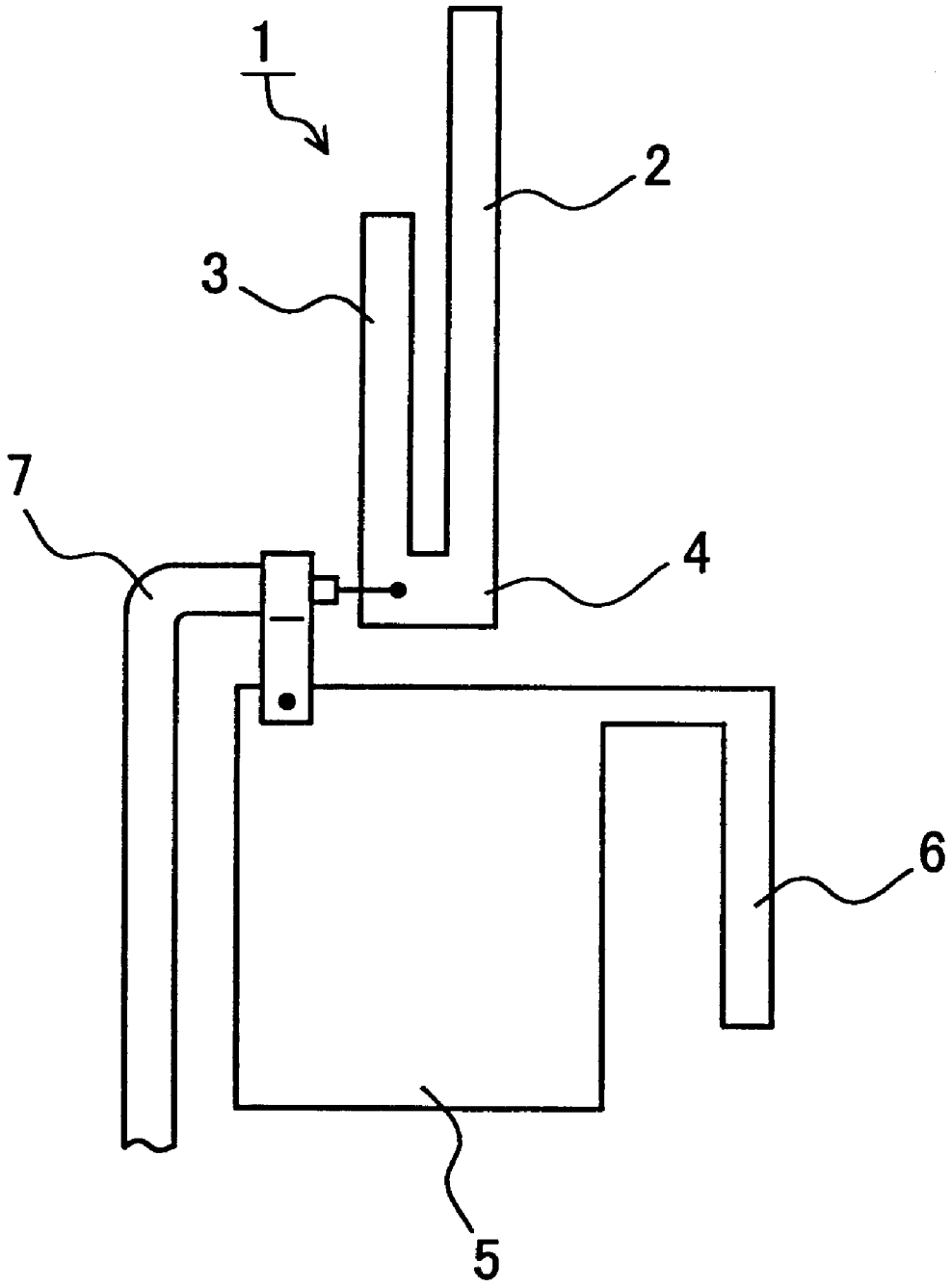
FIG. 3 is a plan view of yet another embodiment (Example 3) of a glass antenna device in accordance with the present invention.

Example 3 is an example of a configuration in which the impedance-adjusting pattern 6 is provided at the top of the grounding pattern 5 (see FIG. 3).

In the antenna pattern shown in FIG. 1, the impedance-adjusting pattern 6 was provided at the bottom of a side of the grounding pattern 5, but in the antenna pattern of this Example 3, it is provided at the top of the grounding pattern 5. Other aspects are the same as in Example 1.

COMPARATIVE EXAMPLE

Figure 4:
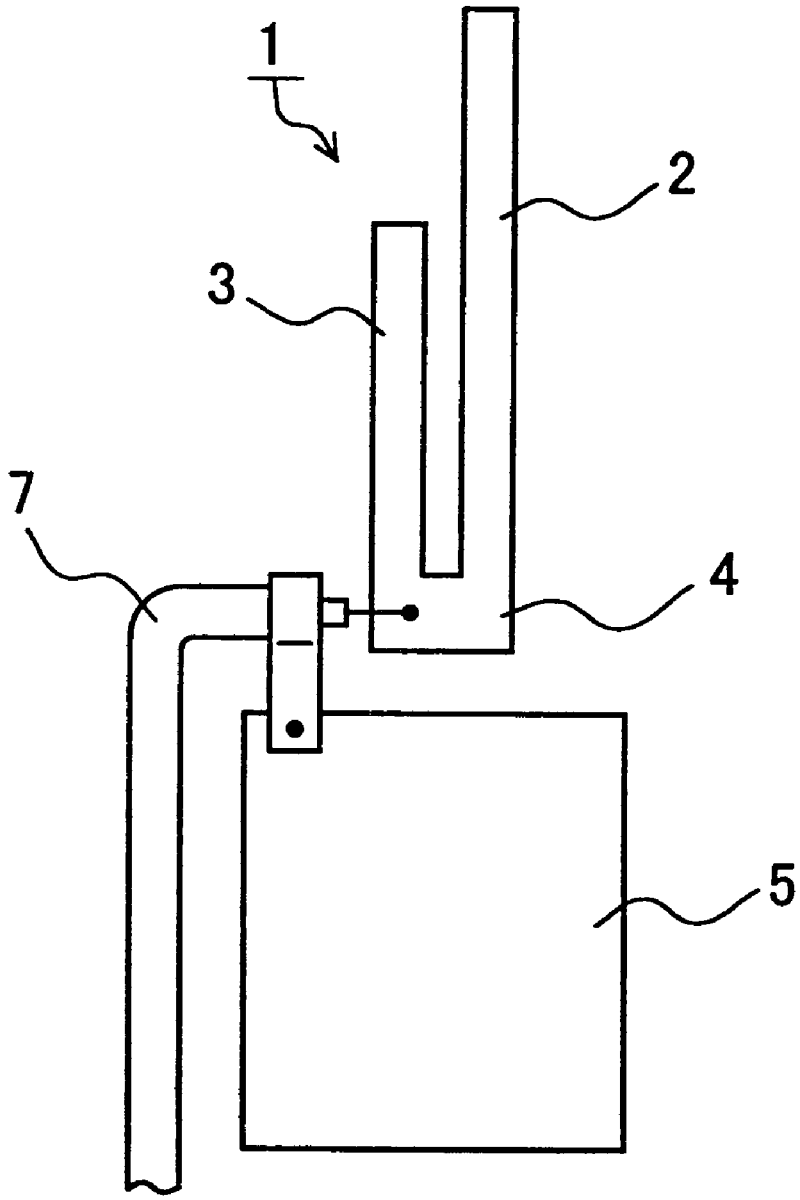
FIG. 4 (PRIOR ART)
FIG. 4 is a plan view of a glass antenna device without an impedance-adjusting pattern (Comparative Example).

Except that no impedance-adjusting pattern is provided, an antenna pattern as in Example 1 was prepared (see FIG. 4).

EXAMPLE 4

Figure 5:
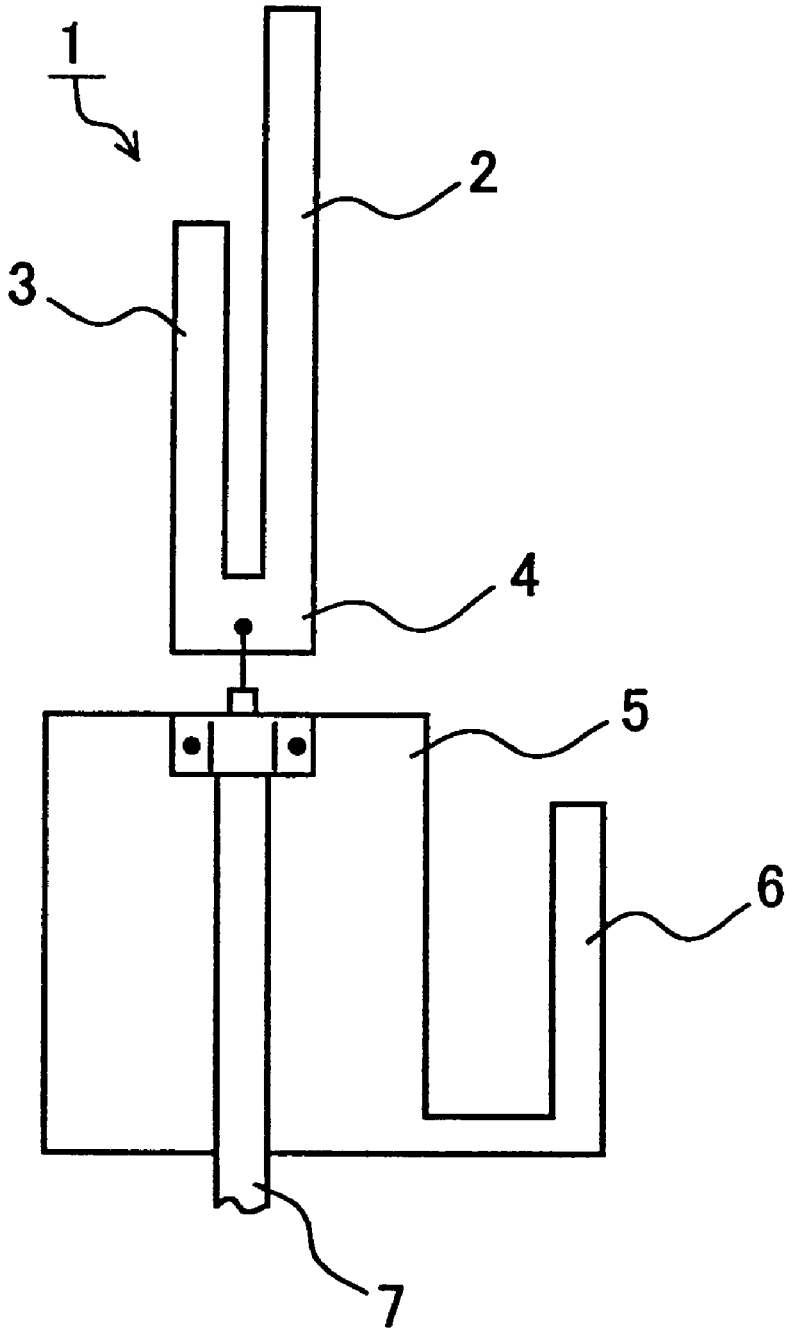
FIG. 5 is a plan view of another embodiment (Example 4), with a different way of leading the coaxial cable.

FIG. 5 shows an example in which the leading of the coaxial cable is different from Example 1. In the glass antenna device of FIG. 1, the coaxial cable 7 is provided along an outer peripheral portion of the grounding pattern 5. Furthermore, the front end of the coaxial cable 7 is arranged from the side, between the U-shaped antenna pattern 1 and the grounding pattern 5. The core conductor is connected to the coupling pattern.

In Example 4, on the other hand, the coaxial cable 7 traverses the grounding pattern 5, and the core conductor of the coaxial cable 7 is connected to the feeding point and the braided conductor is connected to a grounding point. Other aspects are the same as in Example 1.

Figure 6:
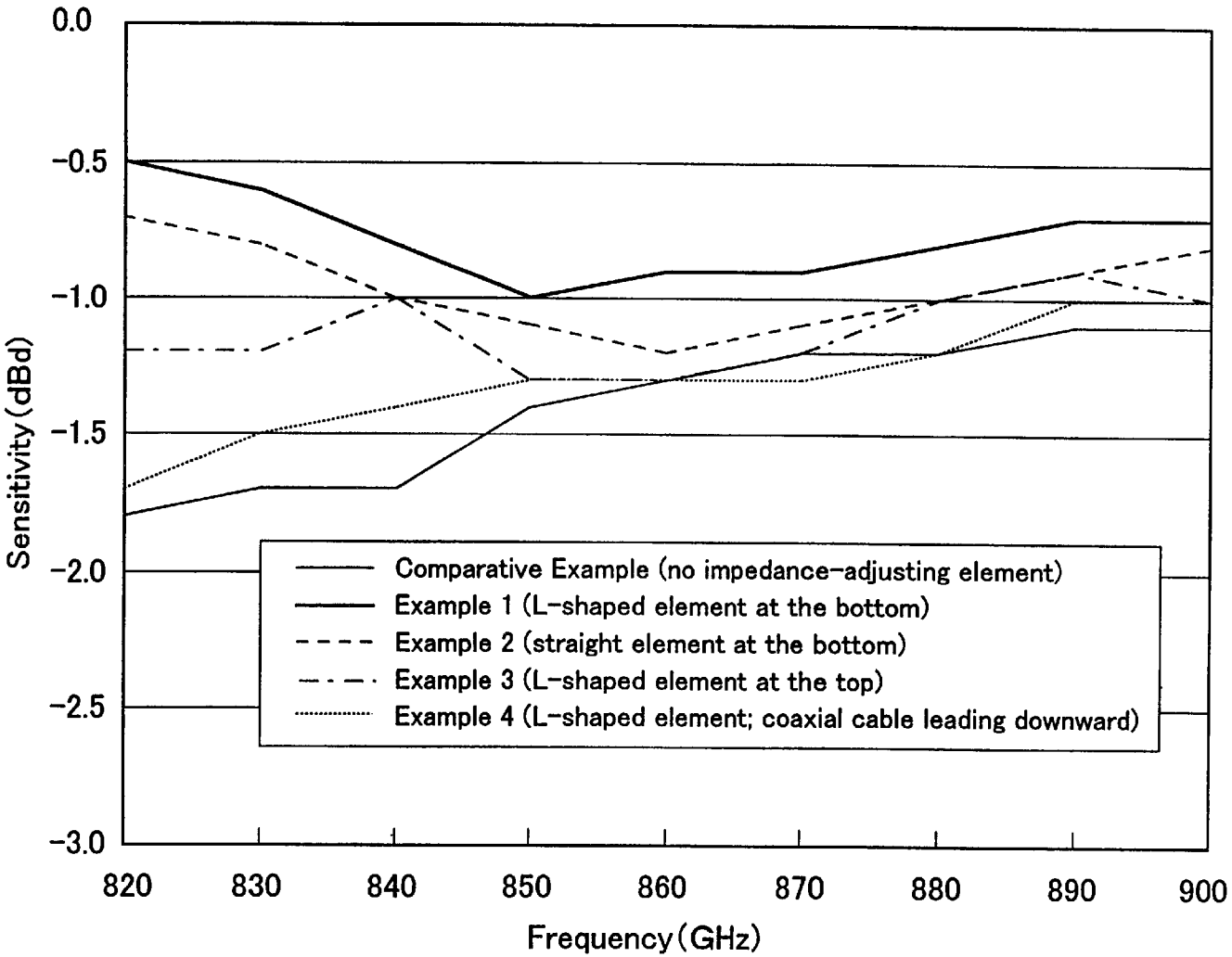
FIG. 6 is a graph of the gain in the glass antenna devices in the 800 MHz band.
Figure 7:
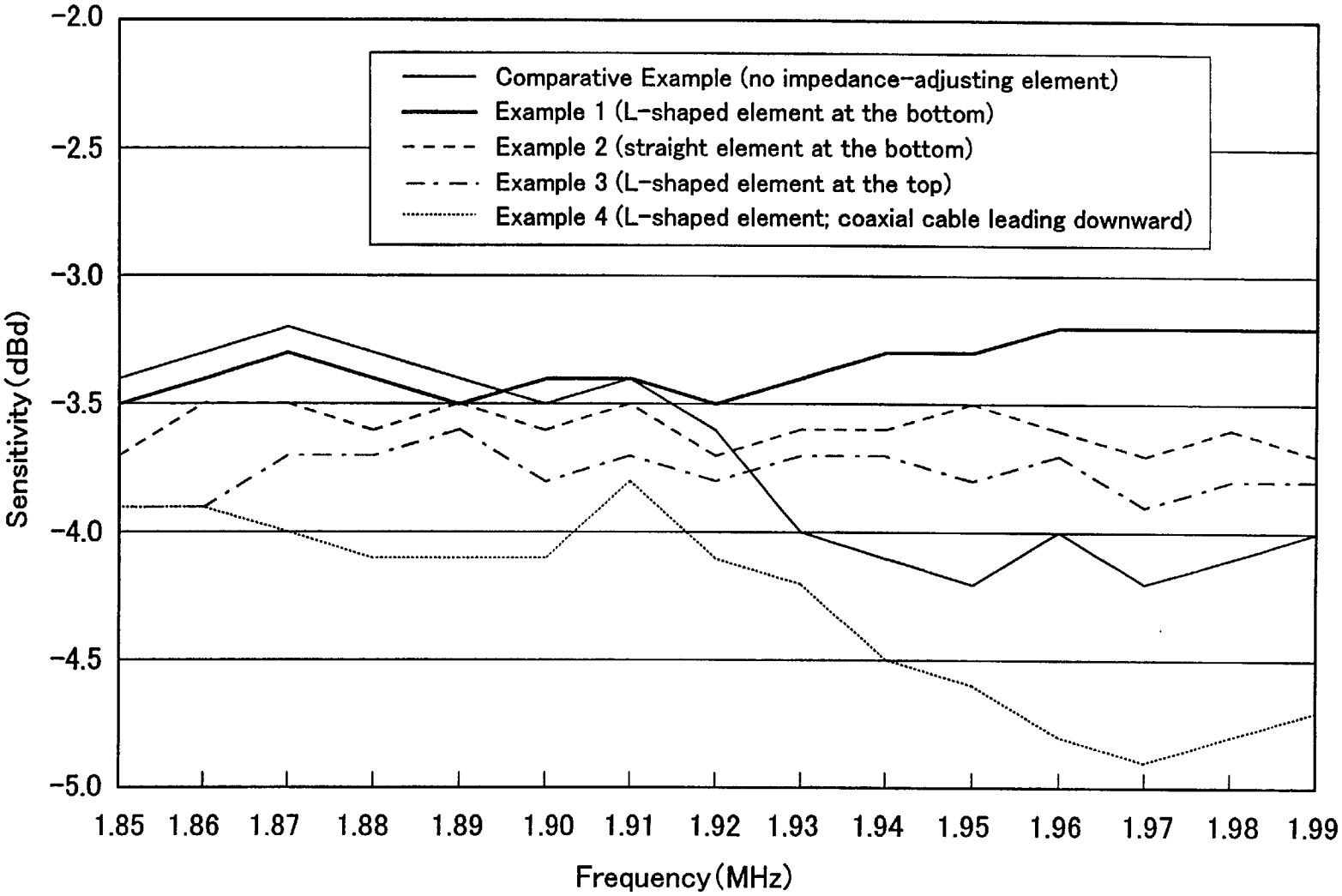
FIG. 7 is a graph of the gain in the glass antenna devices in the 1.8 GHz band.

The gain for the 800 MHz band and the 1.8 GHz band in the glass antennas of the above-described Examples 1, 2, 3, 4 and the Comparative Example was measured. The results are shown in FIGS. 6 and 7.

Figure 8:
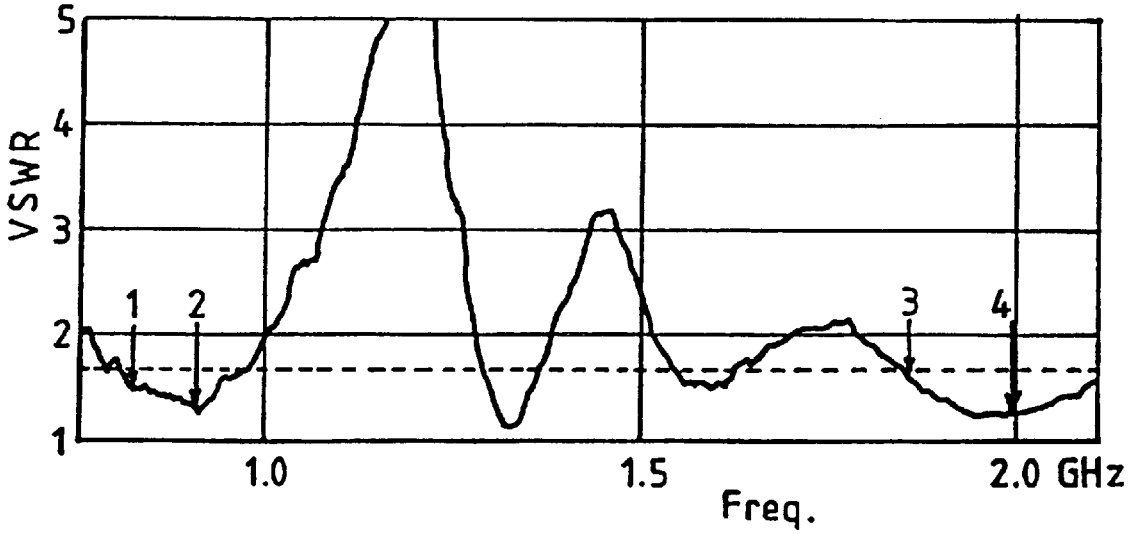
FIG. 8 is a graph showing the impedance measurement results in the glass antenna device of Example 1.
Figure 9:
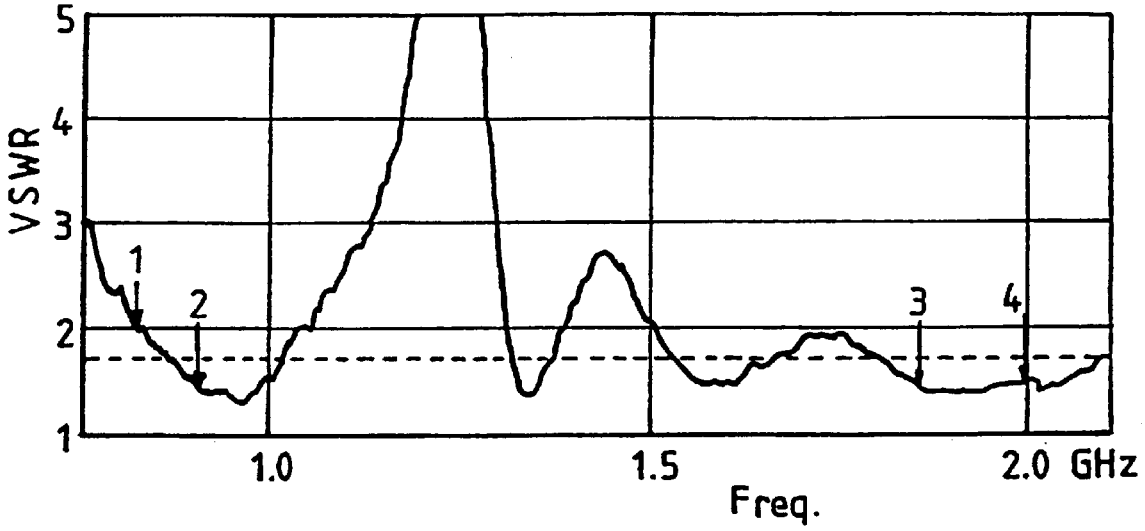
FIG. 9 ( PRIOR ART )
FIG. 9 is a graph showing the impedance measurement results in the glass antenna device of the Comparative Example.

Moreover, the measurement results of the impedance of Example 1 and the Comparative Example are shown in FIGS. 8 and 9, respectively.

Measurement Results

Sensitivity

As becomes clear from FIG. 6, by providing Example 1 with an impedance-adjusting pattern, an excellent sensitivity can be attained compared to the Comparative Example in the same band. Furthermore, as becomes clear from FIG. 7, especially in the frequency band above 1.92 GHz, the sensitivity of the Comparative Example is below that of Example 1.

Leading of the Coaxial Cable

Comparing Example 1 and Example 4, it can be seen that arranging the coaxial cable as in Example 1 improves the receiver sensitivity compared to that of Example 4. The reason for this is that if the coaxial cable is led across the grounding pattern, the braided conductor of the coaxial cable acts like the grounding pattern, so that the original impedance of the grounding pattern deviates.

It can also be understood that in the embodiment of Example 1, the coaxial cable is not arranged to overlap with the grounding pattern.

Impedance Measurement Results

The following is a comparison of the results of the impedance measurements for Example 1 and the Comparative Example (FIGS. 8 and 9). In such a glass antenna device, the desired numerical value is a VSWR of 1.7 or less. In the drawings, VSWR=1.7 is indicated by a broken line.

In Example 1, the VSWR is lower than 1.7 in the complete 800 MHz band and the complete 1.8 GHz band. In the drawings, the specific numerical values indicated by the arrows (↓) are point 1 (820 MHz): 1.458,
point 2 (900 MHz): 1.308,
point 3 (1.85 GHz): 1.605,
point 4 (1.99 GHz): 1.233.

Although all of the 1.8 GHz band in the Comparative Example is below 1.7, the VSWR is higher than 1.7 at the 800 MHz band. In the drawings, the specific numerical values indicated by the arrows (↓) are point 1 (820 MHz): 1.967,
point 2 (900 MHz): 1.451,
point 3 (1.85 GHz): 1.454,
point 4 (1.99 GHz): 1.498.

Application Example

The following is an explanation of an example in which a glass antenna device for mobile communication as described above was applied to a vehicle. The assignee of this invention has also applied for a design patent for an antenna for a car telephone (Japanese Registered Design Patent Nos. 993256 and 1001327).

Figure 10:
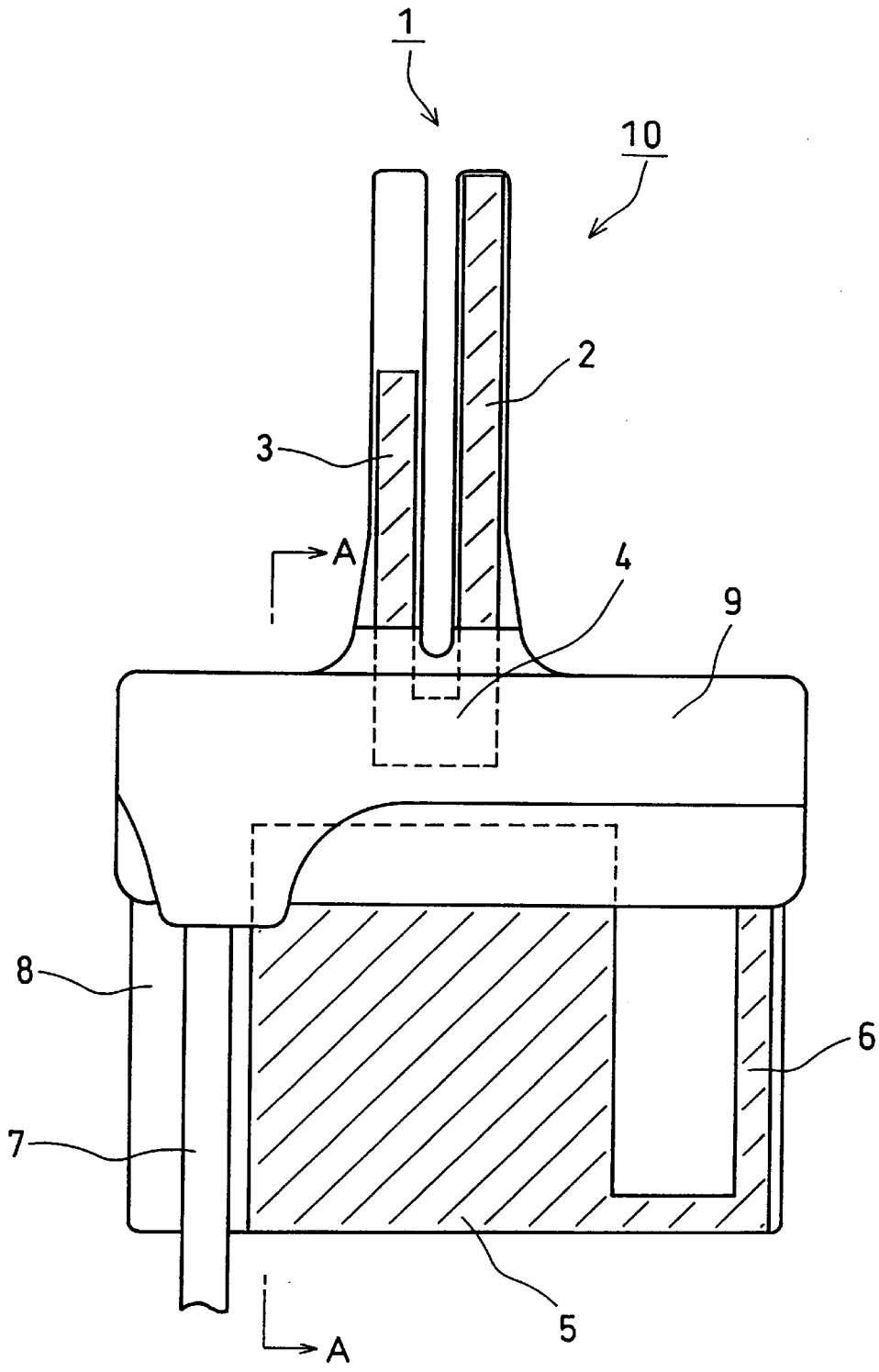
FIG. 10 illustrates an application example of a glass antenna device of the present invention.

FIG. 10 illustrates an application example of this glass antenna device. This antenna is for a car telephone. In the glass antenna device 10, the above-described U-shaped antenna pattern 1, the grounded pattern 5, and the impedance-adjusting pattern 6 are arranged on one insulating substrate, for example a glass epoxy substrate 8.

The core conductor of the coaxial cable 7 is connected to the feeding point, and the braided conductor of the coaxial cable 7 is connected via a fitting to the grounding point. The fitting is fastened to the glass epoxy substrate 8 with screws.

A cladding case 9, which has a guide groove portion for arranging the coaxial cable 7 along the outer peripheral portion of the grounding pattern 5, is provided. This cladding case 9 accommodates the connection portions (feeding point and grounding point) of the coaxial cable 7 and covers at least the top of the grounding pattern 5.

A double-sided adhesive tape is attached to the opposite surface of the glass epoxy substrate 8. The glass antenna device 10 is attached to a vehicle window glass with this double-sided adhesive tape.

In this application example, the coupling pattern 4, the grounding pattern 5 and the impedance-adjusting pattern 6 are arranged in a range of 46×54 mm vertically by horizontally on the glass epoxy substrate 8, as shown in FIG. 10. Furthermore, the first radiation antenna pattern 2 and the second antenna pattern 3 are formed on corresponding substrates extending from the glass epoxy substrate 8.

Considering the outward appearance, the extending substrate portions should have the same length as that of the longer radiation antenna pattern. Also with regard to outer appearance, the glass epoxy substrate should be coated with black paint, regardless of whether a radiation antenna or a grounding pattern is present or not. The thickness of the glass epoxy substrate 8 is 0.3 mm.

Figure 11:
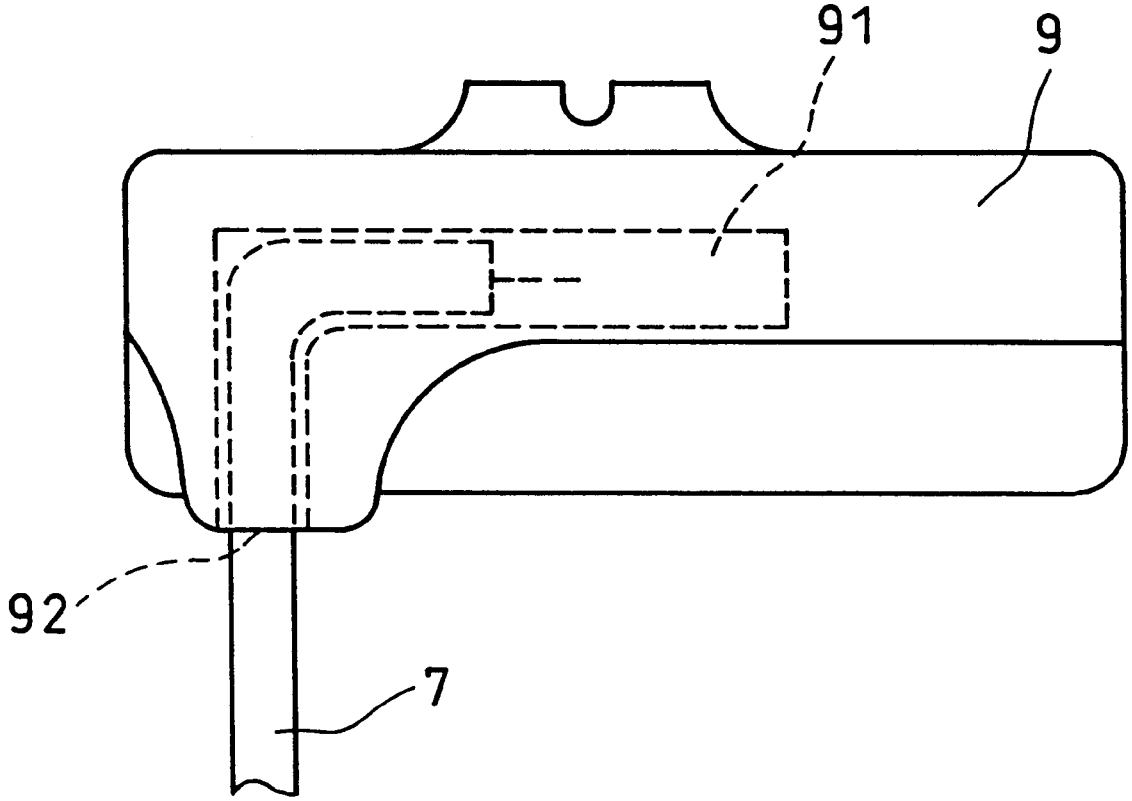
FIG. 11 illustrates a cladding case of the glass antenna device.
Figure 12:
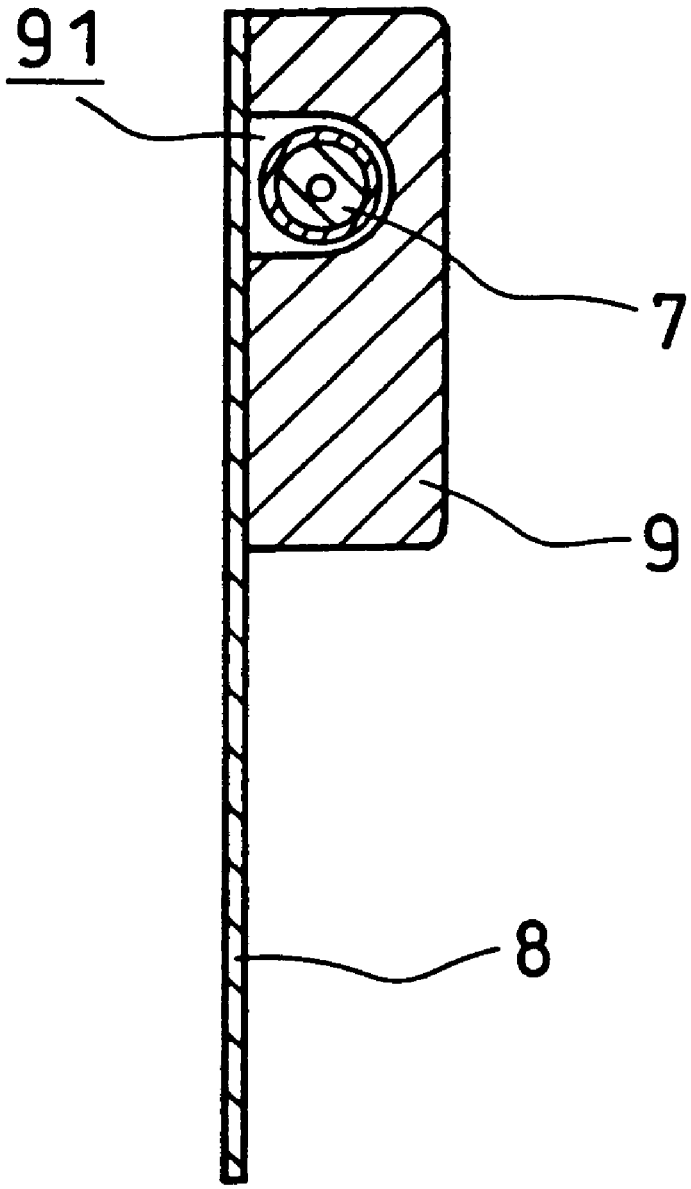
FIG. 12 illustrates the cross-sectional structure of the cladding case of the glass antenna device.

The vertical length of the cladding case 9 is 20 mm and its horizontal length is 57 mm. A guide groove portion 91 for arranging the coaxial cable 7, which is curved almost at a right angle, is formed on the left side of the cladding case 9. An aperture 92 is formed for leading the coaxial cable 7 out of the cladding case 9 (see FIG. 11). The double-sided adhesive tape is attached to the rear surface of the glass epoxy substrate 8. FIG. 12 shows a cross-section of the cladding case 9 through A—A (in FIG. 10).

Figure 13:
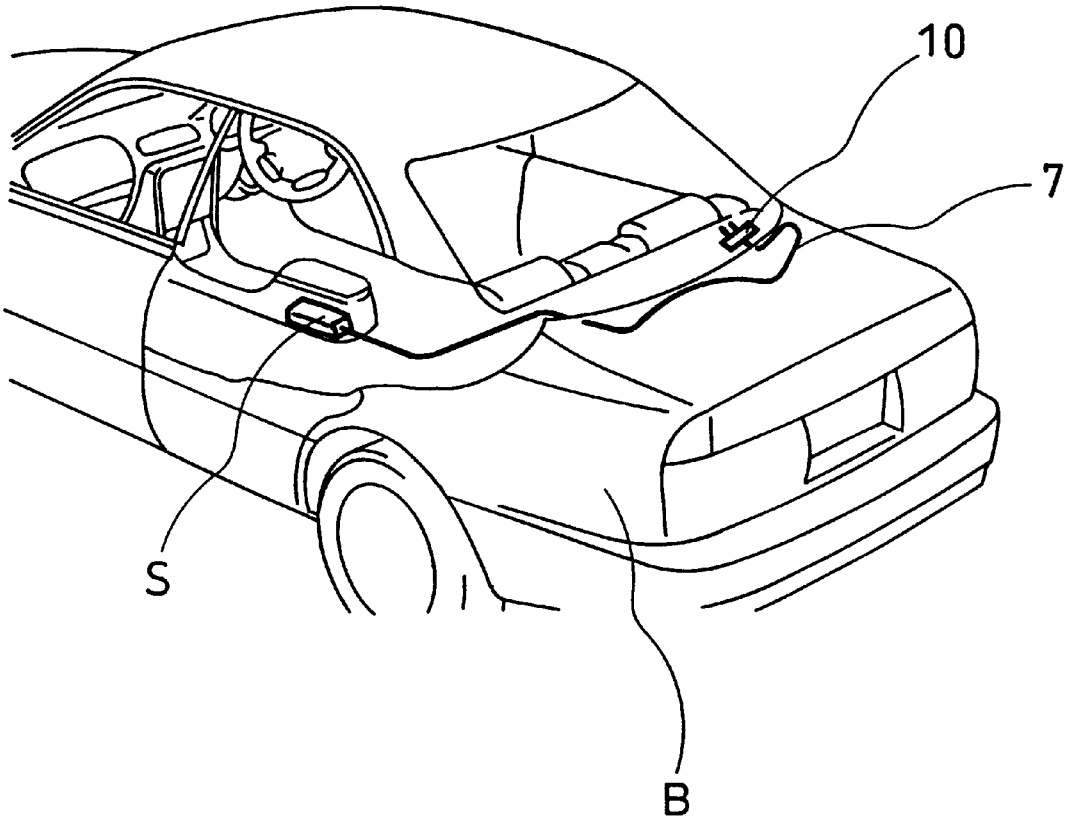
FIG. 13 is a partial cut-away transparent perspective view of an example in which the glass antenna device of the present invention is attached to a car body.

The glass antenna device prepared in this manner is attached, for example, to a lower portion of the rear glass of a sedan-type vehicle. The other end of the coaxial cable 7 is connected for example with a mobile phone, via a mobile phone car adapter S (see FIG. 13).

The invention may be embodied in other specific forms without departing from the spirit or essential characteristics thereof. The embodiments disclosed in this application are to be considered in all respects as illustrative and riot restrictive, the scope of the invention being indicated by the appended claims rather than by the foregoing description, all changes that come within the meaning and range of equivalency of the claims are intended to be embraced therein.

What is claimed is:

1. A glass antenna system for mobile communication, comprising a window glass and an antenna pattern, the antenna pattern comprising:

a U-shaped antenna pattern, in which one end of a substantially straight first radiation antenna pattern and one end of a substantially straight second radiation antenna pattern are coupled by a coupling pattern that is substantially perpendicular to the first and second radiation antenna patterns;

wherein the longitudinal direction of the coupling pattern is arranged substantially in parallel to a rectangular grounding pattern;

wherein a length of the first radiation antenna pattern is different from a length of the second radiation antenna pattern;

wherein the rectangular grounding pattern is arranged below the U-shaped antenna pattern;

wherein a core conductor of a coaxial cable is connected to the U-shaped antenna pattern, and a braided conductor of the coaxial cable is connected to the grounding pattern;

wherein an impedance-adjusting pattern is provided on a lateral portion of the grounding pattern; and wherein the U-shaped antenna pattern, the rectangular grounding pattern and the impedance-adjusting pattern are positioned on the window glass.

2. The glass antenna system for mobile communication of claim 1, wherein the impedance-adjusting pattern is substantially L-shaped.

3. The glass antenna system for mobile communication of claim 1, wherein the length of the first radiation antenna pattern is approximately $\lambda_1/4$–$\lambda_1/6$ with $\lambda_1$ being a first wavelength, and wherein the length of the second radiation antenna pattern is approximately $\lambda_2/4$–$\lambda_2/6$ with $\lambda_2$ being a second wavelength.

4. The glass antenna system for mobile communication of claim 3, wherein a length of the impedance-adjusting pattern is approximately $\lambda_1/4$–$\lambda_1/6$.

5. The glass antenna system for mobile communication of claim 3, wherein the horizontal length and the vertical length of the grounding pattern are both approximately $\lambda_2/4$–$\lambda_2/6$.

6. The glass antenna system for mobile communication of claim 1, wherein the impedance-adjusting pattern is provided at a lower portion of the lateral portion of the grounding pattern.

7. The glass antenna system for mobile communication of claim 1, wherein electricity is supplied to the U-shaped antenna pattern by connecting the core conductor of the coaxial cable, which is arranged along an outer peripheral portion of the grounding pattern, to the coupling pattern.

8. The glass antenna system for mobile communication of claim 1, wherein the coaxial cable does not overlap with the grounding pattern.

9. The glass antenna system for mobile communication of claim 1, wherein a width of the first radiation antenna pattern is approximately 1–5 mm and a width of the second radiation antenna pattern is approximately 1–5 mm.

10. The glass antenna system for mobile communication of claim 1, wherein a spacing between the first radiation antenna pattern and the second radiation antenna pattern is approximately 2–10 mm.

11. The glass antenna system for mobile communication of claim 1, wherein the U-shaped antenna pattern and the grounding pattern are provided on one glass epoxy substrate.

12. The glass antenna system for mobile communication of claim 11, further comprising a cladding case having a guide groove portion for covering the grounding pattern, accommodating one end of the coaxial cable and holding the coaxial cable.

* * * * *